US005322342A

United States Patent [19]

Gange

[11] Patent Number: 5,322,342

[45] Date of Patent: Jun. 21, 1994

[54] CHAISE LOUNGE HAVING INTEGRAL MISTING SYSTEM

[76] Inventor: Donald Gange, 617 E. Harwood, Madison Heights, Mich. 48071

[21] Appl. No.: 927,188

[22] Filed: Aug. 7, 1992

Related U.S. Application Data

[63] Continuation of Ser. No. 712,668, Jun. 10, 1991, abandoned.

[51] Int. Cl.[5] ..... A47C 7/74; B05B 17/00

[52] U.S. Cl. ..... 297/180.15; 239/289

[58] Field of Search ..... 297/180; 239/269, 279, 239/289

[56] References Cited

U.S. PATENT DOCUMENTS

| | | | |
|---|---|---|---|
| 3,625,434 | 12/1971 | Kitover | 239/289 |
| 4,548,357 | 10/1985 | Schmidt | 239/289 |
| 4,765,542 | 8/1988 | Carlson | 297/180 X |
| 4,846,525 | 7/1989 | Manning | 297/180 |
| 4,854,502 | 8/1989 | Cox | 297/180 X |
| 4,961,535 | 10/1990 | Skibik | 297/180 X |
| 5,000,384 | 3/1991 | Arnold | 297/180 X |

*Primary Examiner*—Peter R. Brown

*Attorney, Agent, or Firm*—Gifford, Groh, Sprinkle, Patmore and Anderson

[57] ABSTRACT

A chaise lounge is provided having an integral misting system. More particularly, the misting system is disposed on the inner side of the chair frame and between the webbing of the chair. Four spray zones are provided, two on each side of the user when disposed in a reclining position. A "T" connector interattaches the ends of the misting hose loop and includes a threaded end for removable attachment thereto of a garden hose. A water flow control valve is preferably mounted to the "T" connector for operation by the user.

7 Claims, 2 Drawing Sheets 10
12
14
16
18
20
22
24
26
28
30
32

30
32
48
50
58
60

10
22
24
26
28
30
32
34
36
38
40
42
44
46
48
49
50
51
52
54
56

CHAISE LOUNGE HAVING INTEGRAL MISTING SYSTEM

This is a continuation of copending application Ser. No. 07/712,668 filed on Jan. 10, 1991, now abandoned.

BACKGROUND OF THE INVENTION

I. Field of the Invention

The present invention relates to a chaise lounge having an integral misting system. More particularly, the present invention relates to a misting system mounted between the webbing of a chaise lounge. The misting system provides a fine spray over the body of the user.

II. Description of the Relevant Art

Perhaps more than anything else in our lives styles are susceptible to change. Specifically, styles with respect to clothing and appearance go through ebbs and tides according to time. For example, at one time, particularly in the last century, it was fashionable for proper ladies not to have any tanned color in their skins, as this coloring would suggest that the woman was exposed to the sun for a considerable amount of time and therefore must be a peasant or laborer. Accordingly, many people of both sexes went to great lengths to avoid the sun. Many persons powdered themselves so as to make their skin appear even more white than it was naturally.

If at that time white skin represented the upper gentry whose members had time only for relaxation and not for manual labor, then today the style pendulum with respect to tanned skin has swung in exactly the opposite direction. Many people seek to improve their tans by spending time out of doors at the beach, for example, and also going so far as to seek artificial ways to induce a tan. Such artificial measures include attending tanning salons or ingesting "tanning pills" which contain a residue to be absorbed into the fatty tissue of the user which, to the observer, appears to be a tan on the pill-user's skin.

Even after all of these artificial methods are undertaken, people still seek the more "natural" approach of acquiring a tan which is to expose themselves to the sun. This is often done at beaches and by swimming pools. This can also be done in the tan-seeker's backyard by resting upon either the ground or upon a lounge chair. Lying in the sun can be uncomfortable because the sun-seeker's skin does become awfully warm. Occasionally sunbathers will splash water upon themselves in an effort to cool their skin and also to increase the tanning effects of sunlight by taking advantage of the physical properties of water which act to magnify the radiant energy of the sun as it contacts the sunbather's skin. A preferred approach therefore is for the sunbather to have at his or her access a conveniently available source of spray or water. Some people prefer to expose themselves to water by lying out near a sprinkler system.

Other people have been more creative than simply setting up a sprinkler. Specifically, there have been in the past designs to attach misting systems to chaise lounges. Two particular such inventions are relevant to this point.

The first such system is disclosed in U.S. Pat. No. 4,765,542 issued to Carlson in 1988. Carlson discloses a manually controlled, self-contained liquid misting attachment. The system of Carlson includes a water reservoir and a pumping system for spraying water through apertures defined in a tube attached to a sunbather's chair. The system of Carlson is an after-market attachment for the chair.

Another effort at providing a misting system for a chair was made in U.S. Pat. No. 4,548,357 to Schmidt issued in 1985. Schmidt utilizes a conventional lawn chair which has attached thereto a flexible hose which is closed at one end. Again, the misting system of Schmidt is attachable as an after-market device to a conventional and existing chair.

However, both Carlson and Schmidt suffer from the disadvantages commonly associated with after-market attachments. For example, such attachments usually become inoperable because they fail due to their poor method of attachment. Such attachment systems usually also provide unwanted bulk to the system and very often inhibit efficient folding and unfolding of the chair, thus seriously compromising the convenience and utility of the foldable chaise lounge.

Thus none of the known methods at providing a misting system for a chaise lounge overcomes the inherent disadvantages of after-market attachments.

SUMMARY OF THE PRESENT INVENTION

The present invention relates to a chaise lounge chair having an integral misting system provided therewith. The integral misting system includes a flexible braided hose of the type approved by the Food and Drug Administration for use in food service applications. The braiding of the hose increases the durability and longevity of the hose itself.

The frame of the conventional chaise lounge is constructed substantially as an elongated rectangle. The hose of the present invention is adapted to fit along the inner perimeter of the frame and therefore is substantially out of sight of the viewer. The frame of the chaise lounge is divided into three substantially equal portions, a head portion, and a leg portion, and an intermediate portion interconnecting the two. Disposed at the interconnection points are hinged attachments for the legs of the lounge chair. It is at the hinged positions that the front end connects to the intermediate end and the leg end also connects to the intermediate end. Accordingly, in most chaise lounges, this hinged area is not fitted with webbing. Therefore, because there is no webbing at these places, it is at these places that the misting hose is provided with a plurality of apertures for allowing the misting fluid to pass therethrough. Accordingly, the misting unit of the present invention is provided with four misting zones, two on each side of the user as the user appears in the reclining position.

The misting hose is a continuous loop having two ends. Each of the ends connects to two ends of a "T" connector provided preferably at one side of the intermediate portion of the chaise lounge. The third end of the "T" connector includes threads thereon for accommodating the removable attachment of a conventional garden hose. Thus it is the "T" connector which allows for the incoming water to be distributed through the hose itself. Because water pressure is greatest at the incoming ends of the hose, the two misting zones closest to the "T" connector are provided with smaller apertures than are the two misting zones furthest away from "T" connector.

For maximum operational control by the user of the misting system, a valve is provided on the "T" connector which may be selectively adjusted by the user in such a way so that the outflow of misting fluid may be controlled from a great flow to a small flow or to no flow at all. Preferably this control valve is within easy reach of the sunbather.

Accordingly, the misting system of the present invention overcomes the known problems commonly associated with after-market attachment type misting systems.

Other advantages and features of the present invention will become more apparent from the following detailed description when read in conjunction with the accompanying drawing.

BRIEF DESCRIPTION OF THE DRAWING

The present invention will be more fully understood by reference to the following detailed description of the preferred embodiments of the present invention when read in conjunction with the accompanying drawings, in which like reference characters refer to like parts throughout the views, and in which.

DETAILED DESCRIPTION OF THE PREFERRED EMBODIMENT OF THE PRESENT INVENTION

Figure 1:
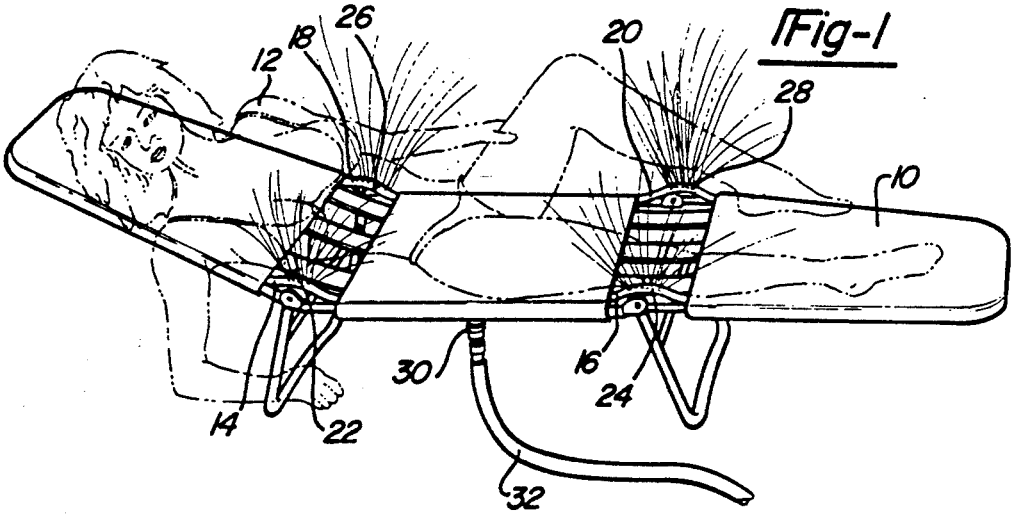
FIG. 1 is a perspective view of the misting chaise lounge according to the present invention.

The drawing discloses the preferred embodiment of the present invention. While the configurations according to the illustrated embodiment are preferred, it is envisioned that alternate configurations of the present invention may be adopted without deviating from the invention as portrayed. The preferred embodiment is discussed hereafter.

Referring to FIG. 1, a misting chaise lounge is generally indicated as 10. A user, shown in broken lines, is illustrated as 12. The lounge 10 includes four exposed misting zones 14, 16, 18, 20. Each of the zones 14, 16, 18, 20 has an upwardly extending arcuate portion including a plurality of misting apertures shown as 22, 24, 26, 28 respectively. The apertures 22, 24, 26, 28 allow for water to pass therethrough and spray in an arcuate pattern in the general direction of the user 12.

A "T" connector 30 (detailed in FIG. 3) is provided for attachment thereto of a conventional garden hose 32.

As can be understood by review of FIG. 1, the misting lounge 10 of the present invention is self-contained and, in all respects except for the misting zones 22, 24, 26, 28, the connector 30 and the hose 32, has the appearance of a conventional chaise lounge.

Figure 2:
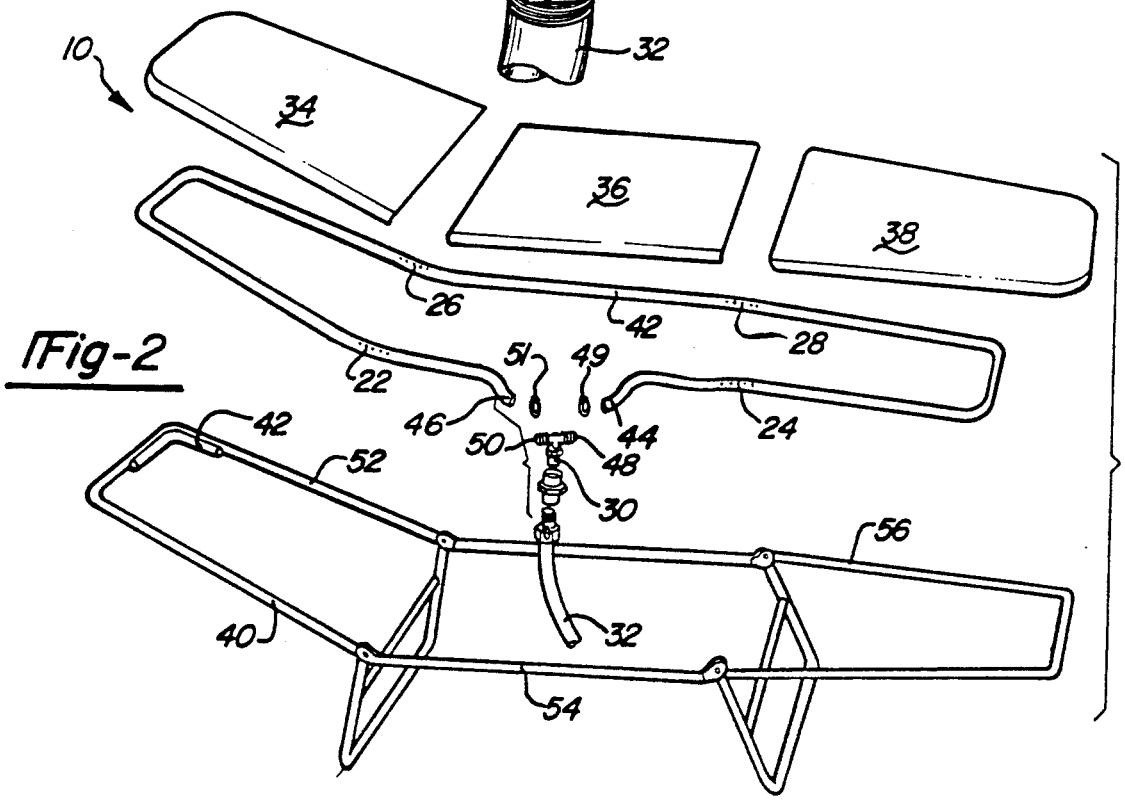
FIG. 2 is an exploded view of the misting chaise lounge of the present invention illustrating the major components of the device.

With reference to FIG. 2, an exploded view of the chair 10 is illustrated to show the component parts of the chair. Three seat sections comprise a head end 34, an intermediate part 36, and a leg end 38. As illustrated in FIG. 1, when these sections are in place gaps are left between them which provides for exposure of the misting zones 22, 24, 26, 28. The sections 34, 36, 38 are fitted to a multi-sectioned frame 40. The multi-sectioned frame 40 includes a head segment 52, an intermediate segment 54, and a leg segment 56.

The heart of the present invention is made up of a misting hose 42 having a first inlet end 44 and a second inlet end 46. The ends 44, 46 are respectively fitted to a pair of fluid outlet ends 48, 50 provided at the upper end of the "T" connector 30. A pair of clamps 49, 51 are used to fasten the ends 48, 50.

Water enters the inlets 44, 46 at even pressure and subsequently enters both ends of the hose 42. Because water pressure is greater near the inlets 44, 46, the apertures 22, 24 are of smaller diameter than are those of the apertures 26, 28 where pressure is lower after some of the water has exited the hose 42 through the apertures 22, 24.

The hose 42 is preferably composed of a flexible yet resilient braided polymerized material. The hose 42 is preferably of a type approved by the U.S. Food and Drug Administration for use in food service applications, thus ensuring minimum risk to the user's health.

The hose 42 is disposed adjacent the inner perimeter of the segments 52, 54 and 56. A cut-away portion of the hose 42 is shown in place attached to the head segment 52. Conventional fasteners (not shown) are used for attachment. Once the hose 42 is in place, the sections 34, 36, 38 are fitted to the frame 40.

Figure 3:
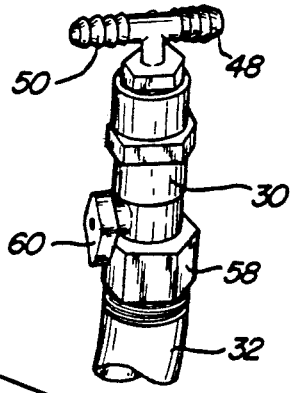
FIG. 3 is a detailed view of the "T" connector according to the present invention.

With reference to FIG. 3, a connector 30 is shown. In addition to the outlet ends 48, 50, an inlet end 58 provides for removable attachment of the garden hose 32. A water control valve 60 is preferably provided on the inlet end 58. The user may therefore selectively control the intensity of the mist by adjusting the valve 60 or may shut the flow of water off completely.

Figure 4:
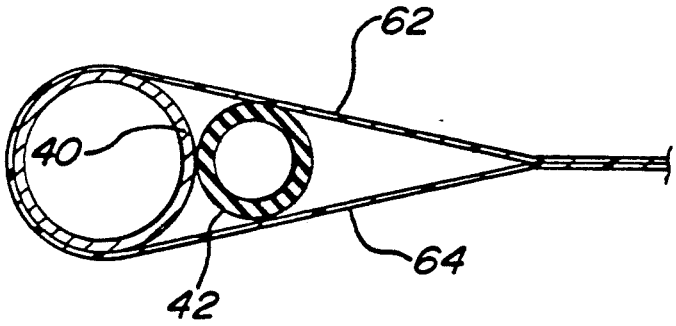
FIG. 4 is a cross-sectional view of a frame member, a water line, and upper and lower sections of webbing.

Referring to FIG. 4, a cross-sectional view of the frame 40, the hose 42, an upper webbed portion 62 and a lower webbed portion 64 is shown. As may be understood by reference to FIG. 4, the hose 42 is situated against the frame 40 (this may also be seen in FIG. 2) and between the upper and lower webbed portions 62, 64 respectively.

Having described my invention, however, many modifications thereto will become apparent to those skilled in the art to which it pertains without deviation from the spirit of the invention as defined by the scope of the appended claims.

I claim:

1. A chaise lounge having an integral liquid misting system, said lounge comprising:

a chair portion, said chair portion including head webbing, intermediate webbing, foot webbing and a frame;

a first gap between said head webbing and said intermediate webbing;

a second gap between said intermediate webbing and said foot webbing;

said frame of said chair portion comprising a pair of parallel elongated side members, each side member having a head end and a foot end, said frame further including a head cross frame member which interconnects said head ends of said side members;

said frame additionally including a foot cross member which interconnects said foot ends of said side members;

said frame having an inner peripheral wall;

a misting system, said misting system including a misting hose, said hose being attached to said inner peripheral wall of said frame within said head webbing, intermediate webbing and foot webbing;

said hose of said misting system including a first end and a second end;

said misting system further including a hose connector having an inflowing fluid port, a first outflowing fluid port interconnected with said first end of said hose and a second outflowing fluid port interconnected with said second end of said hose; and said hose including two pair of misting zones, one pair of said two pair of misting zones being disposed in said first gap and an other pair of said two pair of misting zones being disposed in said second gap, each of said misting zones having an upwardly extending arcuate portion with a plurality of fluid spray apertures selectively defined thereon whereby water is sprayed in an arcuate pattern to substantially cover said chaise lounge.

2. The chaise lounge of claim 1 wherein said inflowing fluid port is removably attachable to a garden hose.

3. The chaise lounge of claim 2 wherein said inflowing fluid port further includes a valve to control the passage of fluid therethrough.

4. The chaise lounge of claim 3 wherein said valve is a variable flow control valve, whereby the user of said chair may selectively control the amount of misting fluid.

5. The chaise lounge of claim 4 wherein said hose is a flexible hose.

6. The chaise lounge of claim 5 wherein said flexible hose is composed of a braided, nylon-reinforced material.

7. The chaise lounge of claim 1 wherein said hose is a flexible hose composed of a reinforced, polymerized material.

* * * * *